US012714233B2

(12) United States Patent
Fratila

(10) Patent No.: US 12,714,233 B2
(45) Date of Patent: Aug. 25, 2026

(54) MOTION IMPARTING LEG FOR ROCKING A BED

(71) Applicant: Inoveris Solutions SRL, Cluj Napoca (RO)

(72) Inventor: Adrian Fratila, Cluj Napoca (RO)

(73) Assignee: Inoveris Solutions SRL, Cluj Napoca (RO)

( * ) Notice: Subject to any disclaimer, the term of this patent is extended or adjusted under 35 U.S.C. 154(b) by 0 days.

(21) Appl. No.: 18/952,747

(22) Filed: Nov. 19, 2024

(65) Prior Publication Data

US 2025/0221543 A1 Jul. 10, 2025

(30) Foreign Application Priority Data

Jan. 4, 2024 (GB) ..... 2400095

(51) Int. Cl.
*A47D 9/04* (2006.01)
*A47C 21/00* (2006.01)

(52) U.S. Cl.
CPC ..... *A47C 21/006* (2013.01); *A47D 9/04* (2013.01)

(58) Field of Classification Search
CPC ..... A47C 21/006; A47D 9/04
USPC ..... 5/1
See application file for complete search history.

(56) References Cited

U.S. PATENT DOCUMENTS 2,888,086 A 5/1959 O'Brien
3,934,283 A 1/1976 Raffel
4,546,301 A 10/1985 Tinebor et al.
4,713,745 A 12/1987 Schauder
4,793,010 A 12/1988 Gross et al.
5,668,421 A 9/1997 Gladish
5,880,416 A 3/1999 Colby et al.
5,923,144 A 7/1999 Seibel et al.
6,068,566 A 5/2000 Kim
6,217,214 B1 4/2001 Cabral et al.
8,239,984 B2 8/2012 Hopke et al.
8,856,982 B1 10/2014 Kalivas
2007/0094792 A1 5/2007 Sims
2007/0129596 A1 * 6/2007 Dickie ..... A47D 9/02 600/26
2012/0249036 A1 10/2012 Iesaki
(Continued)

FOREIGN PATENT DOCUMENTS

CN 2087461 U 10/1991
CN 2500180 Y 7/2012
(Continued)

OTHER PUBLICATIONS

U.S. Appl. No. 18/952,706, filed Nov. 19, 2024 and U.S. Appl. No. 17/851,974, filed Jun. 28, 2022.

*Primary Examiner* — David R Hare
*Assistant Examiner* — Joseane E. Tejada
(74) *Attorney, Agent, or Firm* — HAYES SOLOWAY P.C.

(57) ABSTRACT

A motion imparting leg for imparting an oscillating or reciprocating rectilinear motion to a bed for rocking the bed is provided. The motion imparting leg comprises a base, an upper member movable relative to the base for imparting the oscillating or reciprocating rectilinear motion, a linear shaft motor for driving movement of the upper member, a position sensor for determining the position of the linear shaft motor or the position of the upper member, and a motor controller for controlling the linear shaft motor based on data from the position sensor.

20 Claims, 10 Drawing Sheets

(56) References Cited

U.S. PATENT DOCUMENTS

| | | | |
|---|---|---|---|
| 2015/0250329 | A1 | 9/2015 | Murray |
| 2016/0090189 | A1 | 3/2016 | Wangemann et al. |
| 2016/0303344 | A1 | 10/2016 | Smudde |
| 2016/0329837 | A1 | 11/2016 | Kataoka |
| 2018/0266068 | A1 | 9/2018 | Rines et al. |
| 2019/0238075 | A1 | 8/2019 | Shimizu |
| 2019/0290011 | A1 | 9/2019 | Fratila |
| 2020/0008763 | A1 | 1/2020 | Nebosis et al. |
| 2020/0138200 | A1 | 5/2020 | Sharma et al. |
| 2021/0354566 | A1 | 11/2021 | Ben-Ari |
| 2021/0402133 | A1 | 12/2021 | Kahn et al. |
| 2023/0053418 | A1* | 2/2023 | Fratila ..... H02K 41/025 |
| 2023/0189982 | A1 | 6/2023 | Rubio et al. |

FOREIGN PATENT DOCUMENTS

| | | | | |
|---|---|---|---|---|
| CN | 204378607 | U | | 6/2015 |
| CN | 110062591 | B | | 3/2022 |
| CN | 116603151 | A | | 8/2023 |
| CN | 219499192 | U | * | 8/2023 |
| DE | 29710002 | U1 | | 10/1997 |
| DE | 19841592 | A1 | | 3/2000 |
| DE | 20112953 | U1 | | 11/2001 |
| EP | 0420065 | A2 | | 4/1991 |
| EP | 1900311 | A1 | | 3/2008 |
| EP | 3318162 | A1 | | 5/2018 |
| EP | 3534755 | | | 9/2019 |
| EP | 4137008 | B1 | | 4/2024 |
| ES | 2383364 | A1 | | 6/2012 |
| FR | 2649872 | A1 | | 1/1991 |
| FR | 1103398 | | | 11/1995 |
| KR | 20190127158 | A | | 11/2019 |
| KR | 102090633 | B1 | | 3/2020 |
| TW | M360624 | U1 | | 7/2009 |
| WO | 2005/084497 | A1 | | 9/2005 |
| WO | 2018/083153 | A1 | | 5/2018 |
| WO | 2020/193382 | A1 | | 10/2020 |
| WO | 2021/021835 | A1 | | 2/2021 |
| WO | 2021/115861 | A1 | | 6/2021 |
| WO | 2022/109192 | A1 | | 5/2022 |

* cited by examiner

MOTION IMPARTING LEG FOR ROCKING A BED

CROSS REFERENCE TO RELATED APPLICATION

This application claims benefit of UK Patent Application No. 2400095.2 entitled, "A Motion Imparting Leg for Rocking a Bed" filed Jan. 4, 2024, the entire disclosure of which is incorporated herein by reference.

FIELD OF THE DISCLOSURE

The present disclosure relates to a motion imparting leg for rocking a bed and particularly but not exclusively to a motion imparting leg which imparts an oscillatory or reciprocal rectilinear movement.

BACKGROUND TO THE DISCLOSURE

It is known to provide one or more powered rocking legs or sliders underneath legs of a conventional bed or as replacement legs for the original bed legs. These provide the bed with a back-and-forth motion, for example, a rocking motion which helps some people to fall asleep.

An example of a bed rocking leg is disclosed in the applicant's published patent application GB2610164. However, the mechanical components of the current rocking leg which produce rectilinear movement can still result in problems. For example, in terms of precision of the rectilinear movement or wear of the components over time which can cause noise and/or vibration.

The components of the rocking leg also require regular maintenance. Ball screws (which transform the rotational movement of a standard motor into translational movement) need to be greased once in a while in order to allow the rocking leg to function properly. However, a home user typically cannot grease the components on their own and may not stick to a recommended professional service regime. This can cause wear of the components and other mechanical issues which can affect the rocking of the bed.

The plurality of legs provided for rocking the bed need to be perfectly aligned with each other in order to operate. Therefore, special care and attention is required to fit the legs to the bed frame or legs of the bed. In some cases, the bed frame, for example, made of wood, may deform over time which can also cause some misalignment of the retrofitted rocking legs. This means that the rocking legs would need to be refitted to the bed again in alignment before they can be used properly.

It is an object of the present disclosure to reduce or substantially obviate the aforementioned problems.

SUMMARY OF THE DISCLOSURE

According to a first aspect of the present disclosure, there is provided a motion imparting leg for imparting an oscillating or reciprocating rectilinear motion to a bed for rocking the bed, the motion imparting leg comprising:

- a base;
- an upper member movable relative to the base for imparting the oscillating or reciprocating rectilinear motion;
- a linear shaft motor for driving rectilinear movement of the upper member, the linear shaft motor comprising a fixed part and a moving part spaced apart from each other, the moving part being rectilinearly movable relative to the fixed part;

- a position sensor for determining the position of the linear shaft motor or the position of the upper member; and
- a motor controller for controlling the linear shaft motor based on data from the position sensor.

Rectilinear motion may be considered translational motion back and forth in a horizontal plane of the motion imparting leg.

The moving part of the linear shaft motor comprises an enclosure and a coil wound within the enclosure. The fixed part is a shaft including a plurality of magnets disposed within and along the length of the shaft.

Advantageously, the use of the linear shaft motor removes the need for rotational movement of a standard rotational motor to be transformed or converted to a translation or rectilinear movement. This is because the movement of the linear shaft motor can be directly used to cause movement of the upper member. This requires less components to couple the motor to the upper member, thereby allowing the design of the motion imparting leg to be simpler.

Furthermore, there is no contact or friction between the moving part and the fixed part of the linear shaft motor. Therefore, there is no cogging in the motor. This allows the motor to be noise-free and have high precision. This also reduces the manufacturing and maintenance costs because it removes the need for ball screws which require regular or constant greasing to prevent wear.

The upper member may be disposed above the linear shaft motor. The upper member does not need to be coupled to a threaded rod connected to an end of a shaft of the motor in order to allow rectilinear movement of the upper member. The upper member does not need to be disposed at an end of the motor thereby allowing the motion imparting leg to be more compact.

A rectilinear travel path of the upper member may extend along a length of the fixed part of the linear shaft motor. In some embodiments, the rectilinear travel path of the upper member may extend along a full length of the fixed part of the linear shaft motor. This allows the upper member to move back and forth along the motor. This also helps to keep the motion imparting leg compact because the travel path of the upper member does not extend further than the length of the motor.

The upper member may be adapted to be displaced in a horizontal plane for allowing rotation and translation of the upper member relative to the base.

In some embodiments, the upper member may rotate about a vertical axis of the motion imparting leg by about a few degrees, for example, up to 5 degrees, up to 10 degrees, or up to 15 degrees.

In some embodiments, the upper member may be translated up to 2 mm from its non-displaced position.

Advantageously, this allows the angle of the upper member relative to the base to be changed. Therefore, when a plurality of motion imparting legs is connected to a bed frame or legs of the bed frame, the motion imparting legs do not need to be perfectly aligned with each other to work together. This is also particularly useful when the bed frame deforms over time causing misalignment of the motion imparting legs.

In some embodiments, the upper member may include a flexible or resilient member. The flexible or resilient member may be made from elastomeric material, such as, rubber. This allows the upper member to rotate about the vertical axis of the motion imparting leg or allows the orientation of the upper member to be skewed or changed.

In some embodiments, the whole upper member may be a flexible or resilient member.

The motion imparting leg may further comprise a rectilinear motion assembly to allow the rectilinear movement of the linear shaft motor to cause rectilinear movement of the upper member.

The rectilinear motion assembly may be coupled to the upper member and moving part of the linear shaft motor.

The flexible or resilient member may be the part of the upper member coupled to the rectilinear motion assembly.

A fastener may be provided for securing the rectilinear motion assembly and the upper member together. This further ensures that the upper member and the rectilinear motion assembly are firmly connected to each other.

The fastener may extend through the upper member and rectilinear motion assembly. The fastener may be a bolt or a screw.

The rectilinear motion assembly may include a groove for receiving at least part of the moving part of the linear shaft motor. This allows the rectilinear motion assembly to fit around the linear shaft motor and further allow the motion imparting leg to have a compact design.

The rectilinear motion assembly may comprise a carriage and a linear slider assembly.

In some embodiments, the carriage may form a top of the rectilinear motion assembly. The linear slider assembly may form two sides of the rectilinear motion assembly.

In some embodiments, the carriage may form the top and an upper part of the sides of the rectilinear motion assembly. The linear slider assembly may form a lower part of the sides of the rectilinear motion assembly.

The linear slider assembly may comprise a first slider element coupled to each side or end of the carriage and a second slider element coupled to the base. This allows each second slider element to act as a guide rail and each first slider element to be a movable block which is received on the guide rail. This provides the rectilinear movement of the linear motion assembly.

In some embodiments, each second slider element may be disposed between the linear shaft motor and its corresponding first slider element.

Each first slider element may be substantially T-shaped. Each T-shaped first slider element may have a first member and a second member extending perpendicularly from a centre of the first member.

One end of the first member of each T-shaped first slider element may be disposed 5 next to or face the base.

Each second slider element may be substantially U-shaped. Each U-shaped second slider element may have two arms connected together.

One of the arms of each U-shaped second slider element may be disposed next and abut the base. The outer face of the arm may abut the base.

The second member of each T-shaped first slider element may be disposed and rectilinearly movable between the arms of its corresponding U-shaped second slider element.

An arrangement of magnets may be provided to the rectilinear motion assembly for supporting the weight applied on the upper member and for maintaining the rectilinear movement of the rectilinear motion assembly.

At least one first carriage magnet may be provided to each first slider element. At least one second carriage magnet may be provided to each first slider element.

At least one base magnet may be provided to each second slider element.

The at least one first carriage magnet may be disposed to a lateral side of the at least one base magnet. The at least one first carriage magnet helps maintain the rectilinear movement of the rectilinear motion assembly.

The at least one second carriage magnet may be disposed above or below the at least one base magnet. The at least one second carriage magnet and the at least one base magnet together allow the weight of the bed to be supported by motion imparting leg.

The at least one first carriage magnet and the at least one second carrier magnet may be spaced apart from the at least one base magnet. In other words, a gap may be provided between the at least one first and second carriage magnets and the at least one base magnet.

The gap between the magnets means that there is no contact or friction between the first slider elements and second slider elements. This helps to prevent wear of the rectilinear motion assembly, and no servicing or maintenance is required.

The at least one first carriage magnet, the at least one second carriage magnet and/or the at least one base magnet may be permanent magnets and/or electromagnets.

The linear shaft motor may be spaced apart from the base.

The position sensor may be mounted under the linear shaft motor. The position sensor may be disposed within the space between the linear shaft motor and the base. The position sensor may be mounted to the base.

Alternatively, the position sensor may be disposed anywhere between the moving and fixed parts or components of the motion imparting leg. That is, the position sensor may be provided in any suitable position for sensing relative positions of the moving and fixed parts of the leg.

The position sensor may include a linear encoder for encoding the position of the upper member.

The linear encoder provides precise positioning for low speed and high torque application. It has the added advantage of improving synchronicity when the leg is used with other motion imparting legs.

A shroud may be provided. The shroud may substantially surround at least some of the components of the motion imparting leg. For example, the shroud may enclose the linear shaft motor, upper member and rectilinear motion assembly.

The shroud may be connected to the upper member. A fixing device may be provided to connect the shroud to the upper member. This allows the shroud to rectilinearly move with the upper member and/or be displaced in the horizontal plane with the upper member.

A bed mounting bracket may be provided. The bed mounting bracket may be removably coupled to the upper member and/or the shroud. The bed mounting bracket may couple the motion imparting leg to a bed frame or bed leg of the bed.

A bed coupler may be provided in the bed mounting bracket. The bed coupler may provide a coupling device used to couple to standard bed frame or bed legs, for example, screw apertures may be provided for coupling to a solid wooden bed frame or leg. In other examples, clamps, grips or similar, may be provided for coupling to a metal bed frame or leg, especially hollow bed frames or legs.

The motor controller may be configured to use field-oriented control, also known as vector control. This provides a very accurate positioning precision.

The motor controller may comprise a communication device for receiving and/or sending data to a central control hub or a similar motion imparting leg.

The communication device may include a wired communication port.

A safety system may be provided. The safety system may be configured to monitor for unexpected operation of the motion imparting leg.

The safety system may be configured to generate a warning signal based on the motion imparting leg operating unexpectedly. The warning signal may be transmitted to the central control hub.

The safety system may be provided in the motion imparting leg.

The motor controller may comprise the safety system.

The safety system may be configured to monitor for a decoupling (or lack of synchronicity) between the expected motion that may be produced by the linear shaft motor moving part (coils block) and the actual displacement executed by the coils block (which is connected to the upper member).

For example, the safety system may monitor if the upper member position is out of synchronisation against an expected or desired position dictated by the motor controller. This may be the case when the linear shaft motor displacement or movement is blocked by an obstacle, motor coils are burned, or connection wires are disconnected, amongst other possible events.

The safety system may be configured to generate a decoupling warning signal as a result of determining a decoupling between the expected motion of the linear shaft motor and the actual executed motion. The decoupling warning signal may be used to shut down the motion imparting leg.

Decoupling may be indicated by a difference between the expected position of the upper member and the actual position of the upper member.

The safety system may be configured to monitor for excessive rectilinear motion. That is to say the safety system may be configured to monitor for rectilinear motion outside of the motion or travel path length.

The safety system may be configured to generate an excessive rectilinear motion warning signal as a result of determining excessive rectilinear motion of the upper member or other rectilinearly moving component(s) e.g. rectilinear motion assembly. The excessive rectilinear motion warning signal may be used to shut down the motion imparting leg.

The excessive rectilinear motion determination may be based on data from sensors.

The excessive rectilinear motion determination may be based on switches.

The safety system may comprise at least two switches for determining excessive rectilinear motion. The switches preferably being optical switches. Each switch corresponds with a trigger, such as a flange, blade or similar, for actuating the switch. Preferably, the trigger may be configured to interrupt a light path of the optical switch.

Each switch may be disposed toward an end of the motion or travel path of a rectilinearly moving component, such as the upper member or rectilinear motion assembly. Each optical switch may be disposed proximate an end of the second slider element. In such embodiments, the switches may be considered stationary switches because they are in a fixed position relative to the rectilinearly moving component.

Each trigger may be disposed on a rectilinearly moving component, such as the upper member or rectilinear motion assembly. Preferably, a blade or flange extends from each end of the first slider element. In embodiments with a stationary switch, the trigger may be considered a movable trigger because it moves with a rectilinearly moving component.

In other embodiments, each switch may be disposed on a rectilinearly moving component, such as the upper member or rectilinear motion assembly. Preferably, each optical switch may be disposed to an end of the first slider element. In such embodiments, the switches may be considered movable switches because they move with a rectilinearly moving component.

In embodiments with movable switches, each trigger may be disposed toward an end of the motion or travel path of the rectilinearly moving component. Preferably, a blade or flange is disposed proximate each end of the second slider element and extends into the path of the movable switch. In such embodiments, the trigger may be considered a stationary trigger because they are in a fixed position relative to a moving component.

At least one of the switches may be disposed to the same side as the motor controller. That is to say that at least one switch may be proximate the motor controller. This reduces the length of connection wires.

Preferably, the components moving rectilinearly (such as the upper member or rectilinear slider assembly) are restrained or constrained to move between two predetermined points during normal operation. Excessive rectilinear motion may be considered to occur when the components moving rectilinearly move past the predetermined points.

The predetermined points may be set before the motion imparting legs are supplied to a user.

The switches may be positioned so that they are only actuated once the component moves past the predetermined points. That is to say the switches are not actuated during normal operation of the motion imparting leg.

Being able to monitor for excessive rectilinear motion ensures that if the upper member was to move out of the motion or travel path, it can be stopped and later synchronised with other motion imparting legs in a system. A safety system is beneficial as it may detect problems early which can help to prevent the leg from being further damaged.

According to a second aspect of the present disclosure, there is provided a kit of parts comprising a plurality of motion imparting legs according to the first aspect of the present disclosure.

The kit of parts may further comprise a central control hub for connection to each motion imparting leg. The central control hub may synchronise the rectilinear motion of the motion imparting legs.

According to a third aspect of the present disclosure, there is provided a bed retrofitted with a plurality of motion imparting legs according to the first aspect of the present disclosure, wherein the upper member of each motion imparting leg is removably coupled to a bed frame or leg of a bed.

According to a fourth aspect of the present disclosure, there is provided a bed comprising a bed frame and a plurality of motion imparting legs according to the first aspect of the present disclosure, the motion imparting legs being attached around the periphery of the bed frame.

According to a fifth aspect of the present disclosure, there is provided a motion imparting device for imparting an oscillating or reciprocating rectilinear motion to an object, the motion imparting device comprising:

- a base;
- an upper member movable on a motion path relative to the base for imparting the oscillating or reciprocating rectilinear motion to the object; and
- motion path defining means (such as a motor or other drive device, or one or more rails or guides, or another type of drive or guide structure) between the base and the upper member;

in which the upper member is displaceable in a horizontal plane independently of its movement along the motion path, allowing for rotation and/or translation of at least part of the upper member relative to the base and motion path defining means.

The upper member may be displaceable in any direction in the horizontal plane allowing for rotation and/or translation of the upper member.

The upper member may include a device or structure for displacing the upper member in the horizontal plane. This allows the orientation of the upper member to be changed relative to the base.

The upper member may include a flexible or resilient member for enabling displacement or stretching or twisting of the upper member in the horizontal plane.

The upper member may comprise rubber or another elastomeric material.

Any feature or independently selected combination of features presented with respect to any of the earlier aspects of the disclosure may be provided in this fifth aspect of the disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

A first embodiment of a motion imparting leg (or device) for imparting an oscillating or reciprocating rectilinear motion to a bed for rocking a bed is generally indicated at 10, as can be seen in FIGS. 1 to 4. A second embodiment of the motion imparting leg (or device) is generally indicated at 100, as can be seen in FIGS. 5 to 8. The same references will be used for similar features in both embodiments.

In the first and second embodiments, the motion imparting leg 10, 100 comprises a rectangular and planar base 12 and an upper member 14 movable relative to the base 12. In use, the base 12 is in contact with the floor and the upper member 14 is coupled to a bed frame or a leg of the bed for imparting the oscillating or reciprocating rectilinear motion to the bed.

A linear shaft motor 16 is provided above the base 12. The linear motor 16 comprises a fixed part 16*a* and a moving part 16*b* which rectilinearly slides along the fixed part 16*a* in direction A-A, indicated in FIGS. 2 and 6. The movement of the moving part 16*b* directly drives the rectilinear movement of the upper member 14. Therefore, there is no need for rotational movement of a motor to be translated into rectilinear movement to drive the movement of the upper member 14. This reduces the number of components required for the motion imparting leg 10, 100 and allows the design to be simpler and more compact than previous designs.

Figure 1:
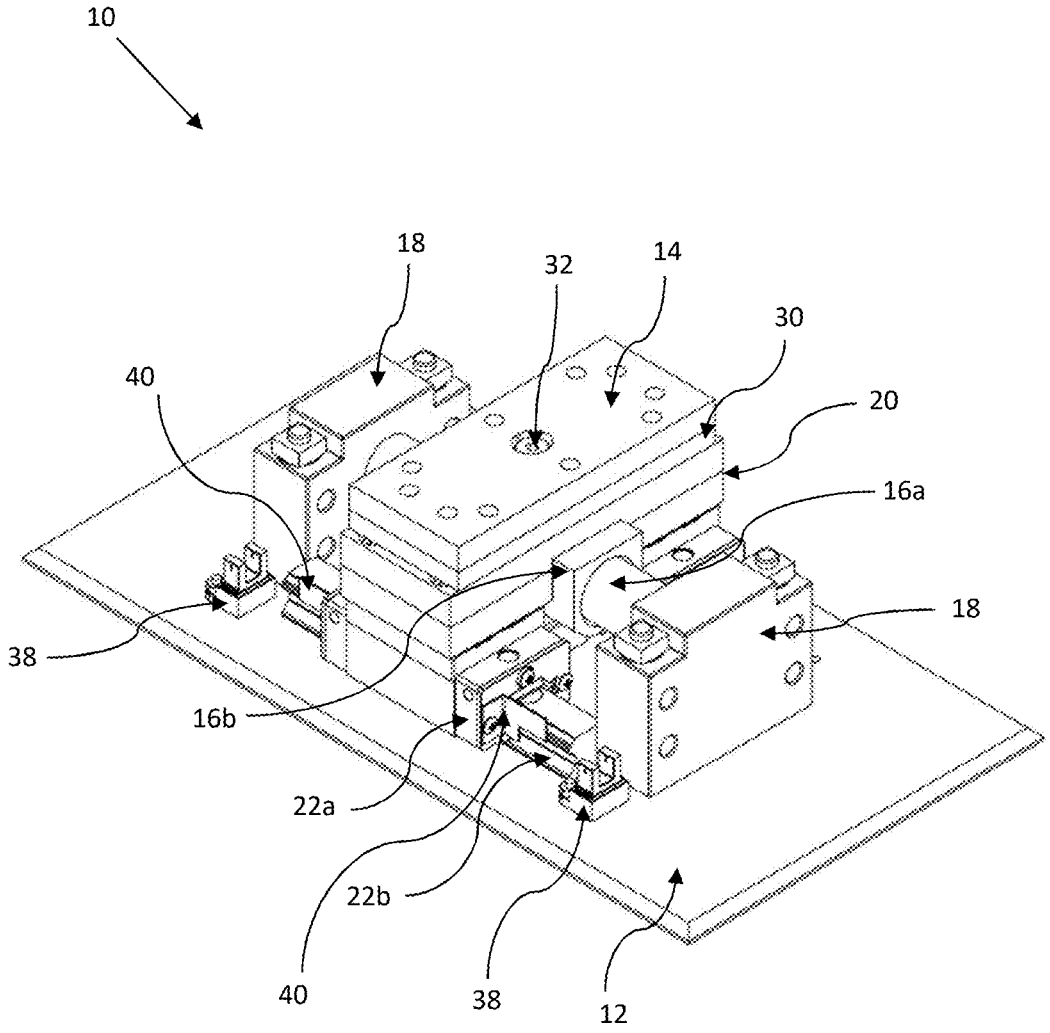
FIG. 1 shows a perspective view of a first embodiment of a motion imparting leg according to the first aspect of the present disclosure.
Figure 2:
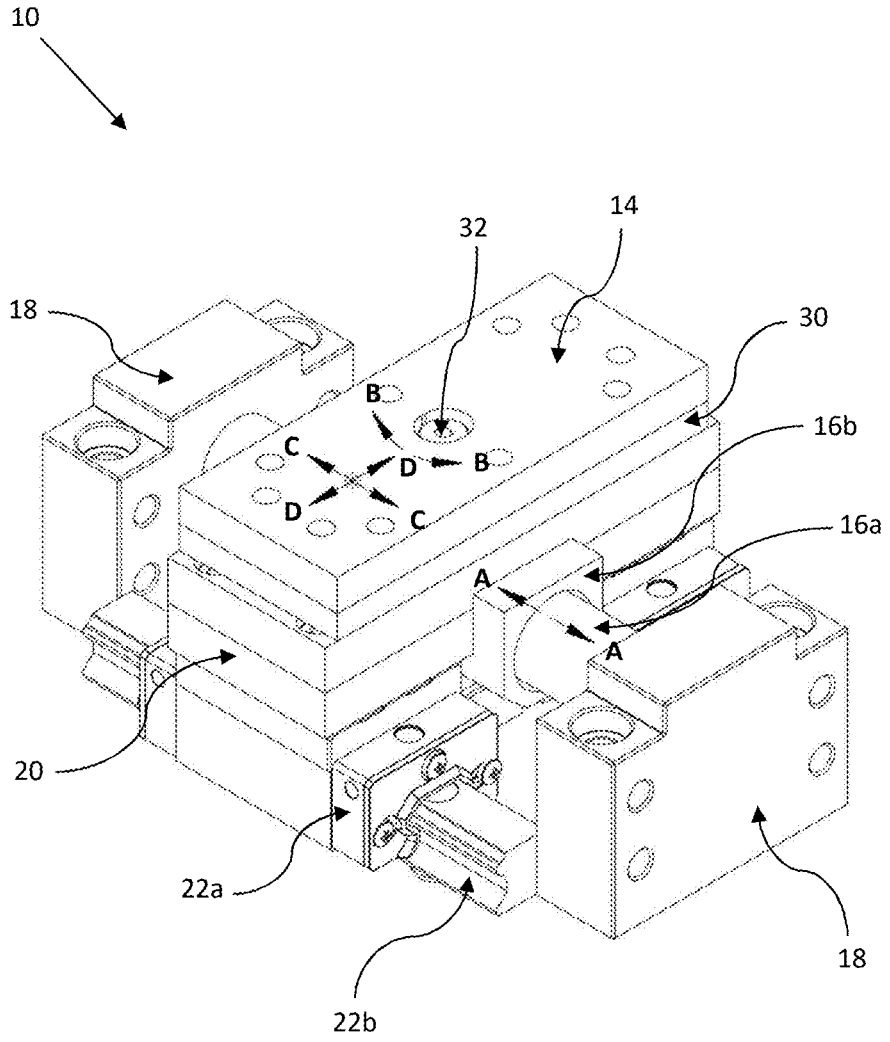
FIG. 2 shows a perspective view of the motion imparting leg of FIG. 1 without a base.
Figure 3:
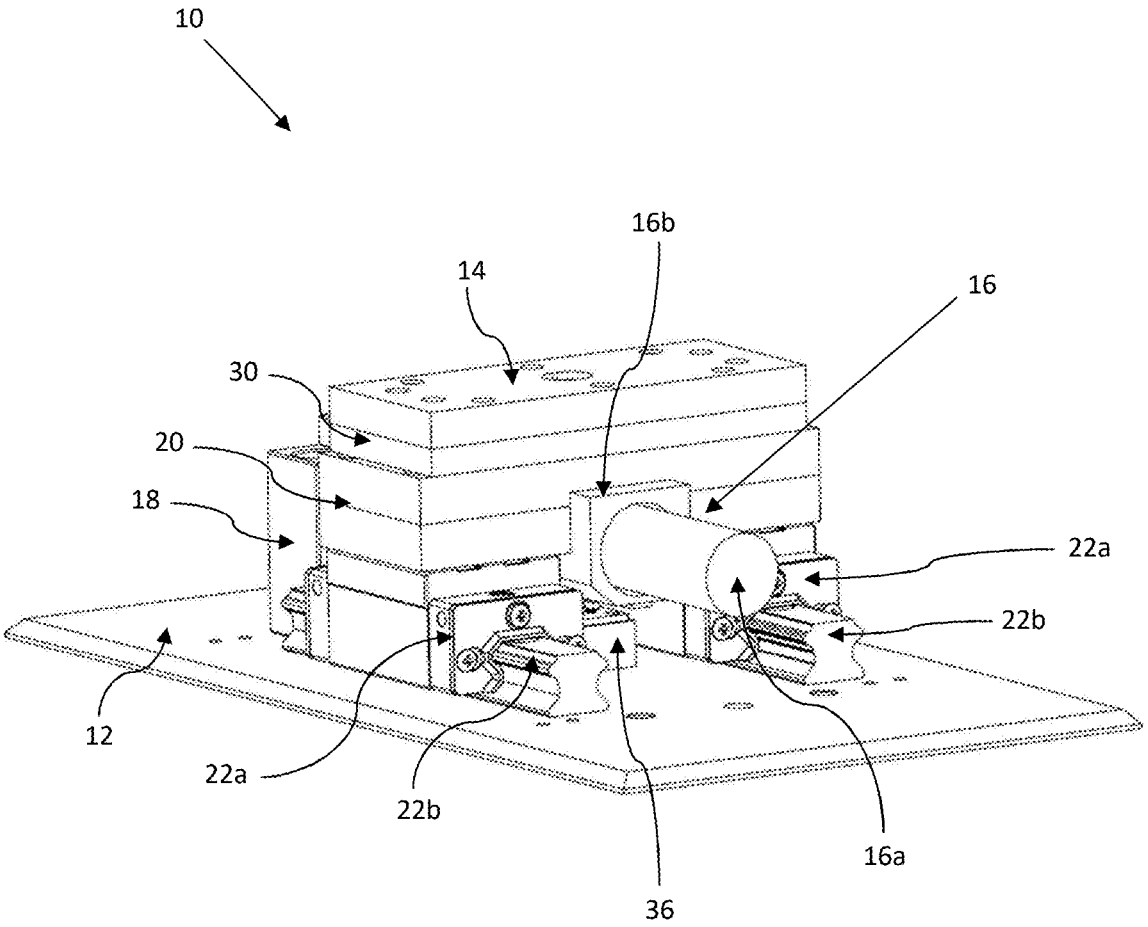
FIG. 3 shows perspective view of the motion imparting leg of FIGS. 1 and 2 with a better view of its linear shaft motor.
Figure 4:
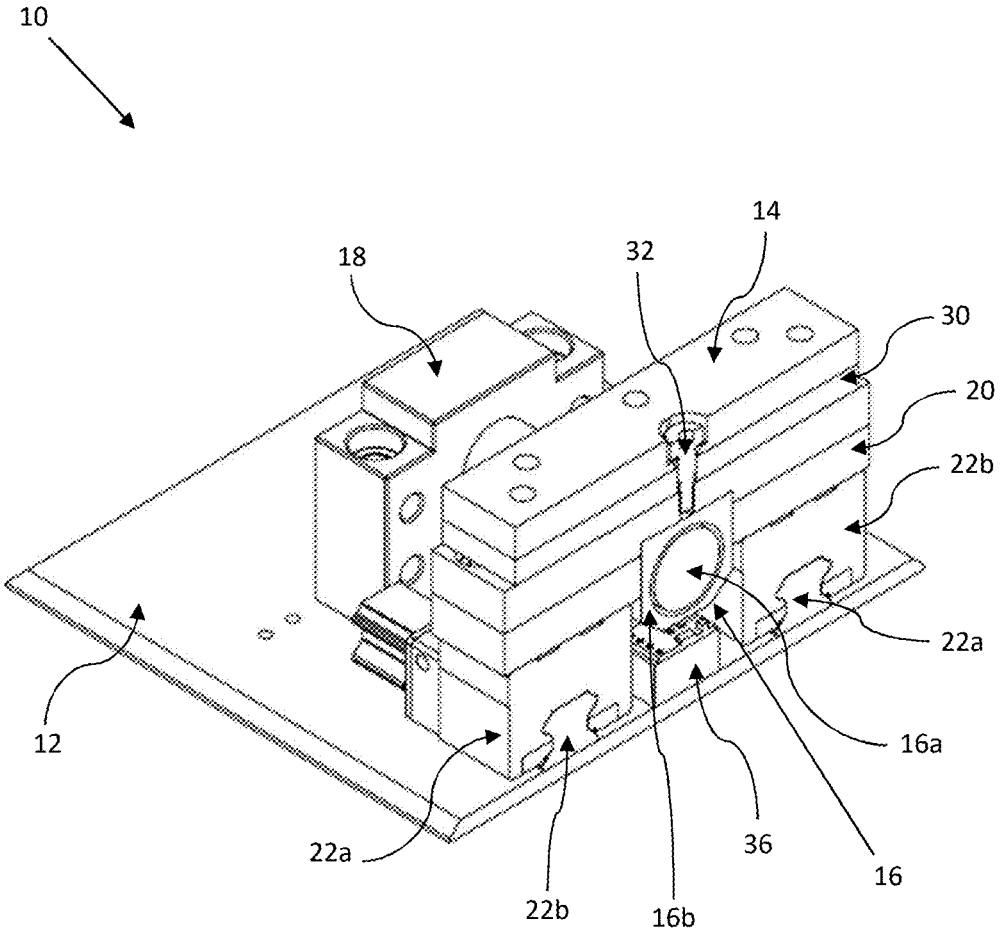
FIG. 4 shows a cross-sectional view of the motion imparting leg of FIGS. 1 to 3.
Figure 5:
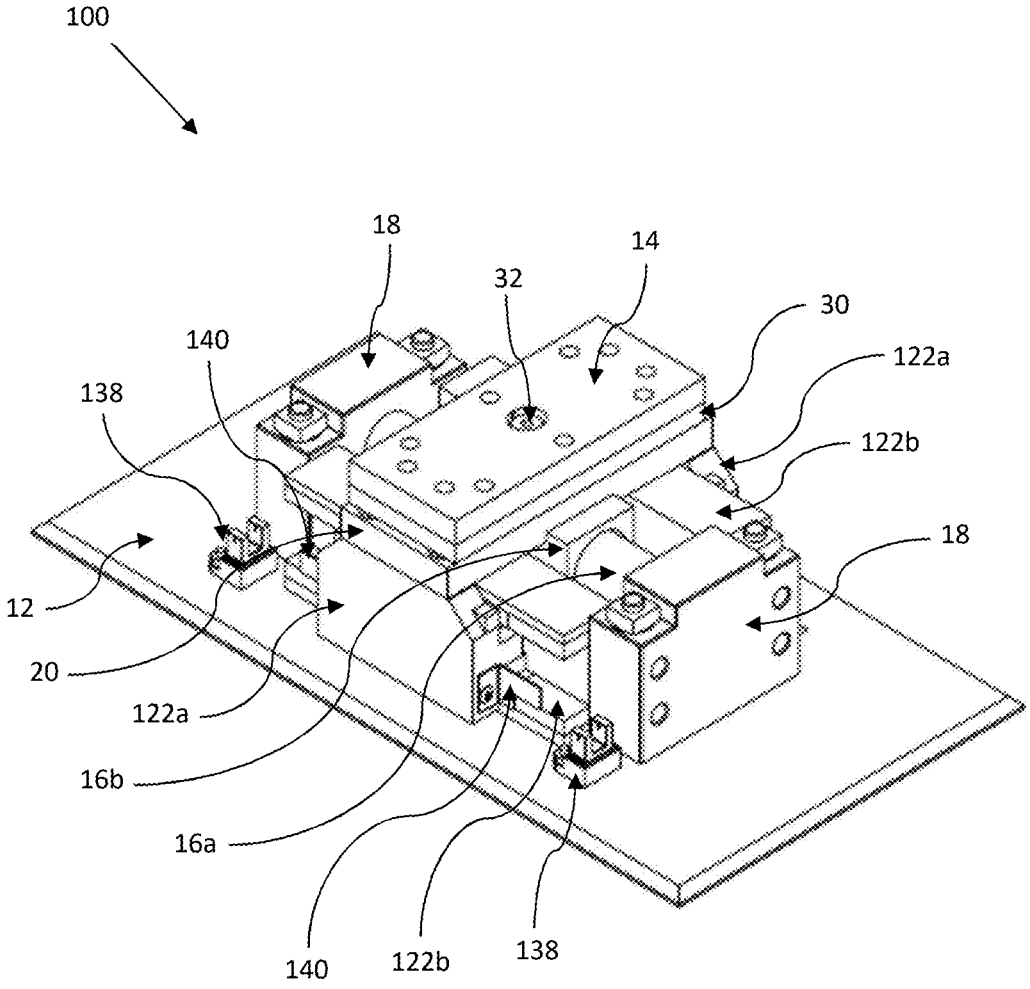
FIG. 5 shows a perspective view of a second embodiment of the motion imparting leg according to the first aspect of the present disclosure.
Figure 6:
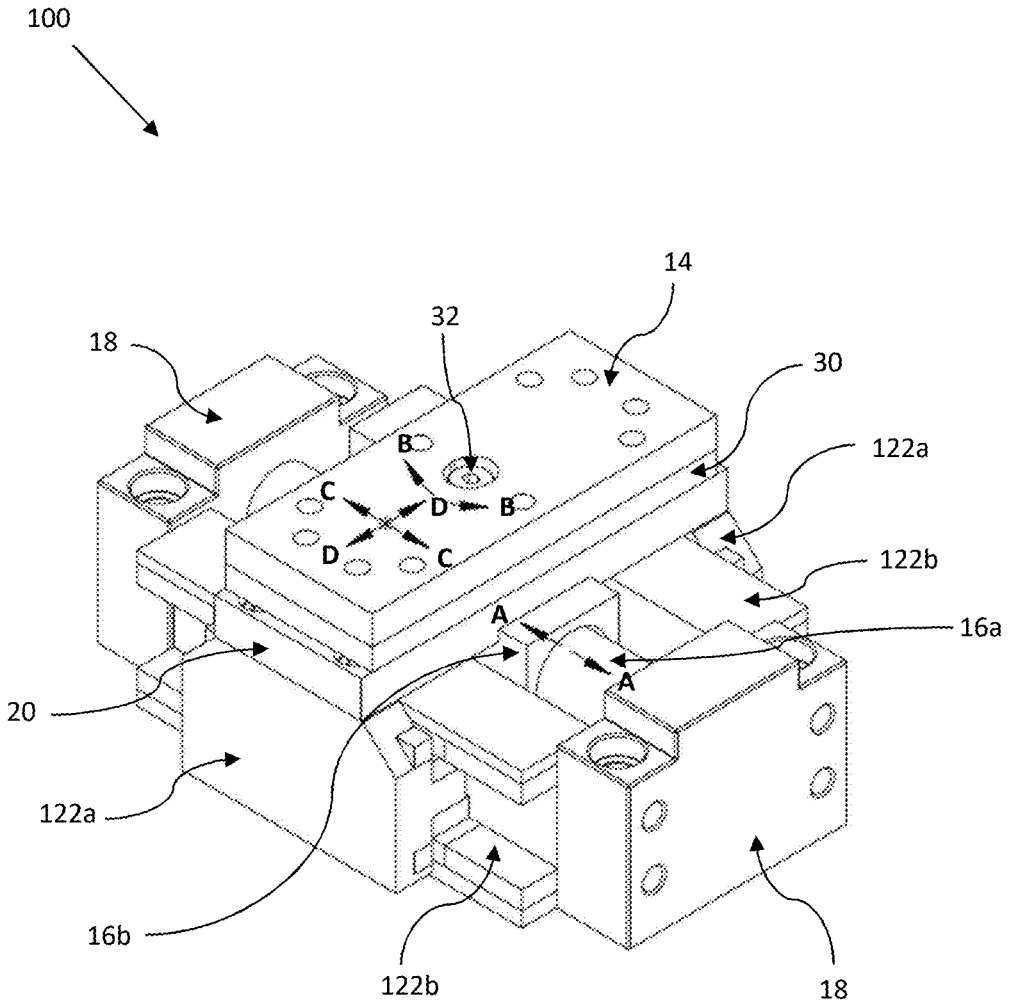
FIG. 6 shows a perspective view of the motion imparting leg of FIG. 5 without a base.

The linear shaft motor 16 can be more clearly seen in FIG. 3.

The fixed part 16*a* of the linear shaft motor 16 is a shaft which extends along the longitudinal length of the base 12. The moving part 16*a* is a rectangular block with an aperture extending through its length, wherein the fixed part 16*a* extends through. The moving part 16*b* includes a coil disposed within the block and cylindrically wound around the aperture. The fixed part 16*a* includes a plurality of magnets disposed along the length of the shaft.

There is a gap between the fixed part 16*a* and the moving part 16*b*. This means that there is no contact or friction between the fixed 16*a* and moving 16*b* parts at any point particularly when the moving part 16*b* slides along the fixed part 16*a*. This provides the linear shaft motor 16 with high precision, noise-free and zero cogging features.

The length of the moving part 16*b* is shorter than the fixed part 16*a*. This allows the moving part 16*b* to rectilinearly slide along the fixed part 16*a*.

Each end of the fixed part 16*a* i.e. each end of the shaft is connected to a block 18 mounted to the base 12. This allows the linear shaft motor 16 to be supported and spaced away from the base 12.

A rectilinear motion assembly is coupled to and substantially surrounds the moving part 16*b* of the linear shaft motor 16.

The rectilinear shaft assembly includes a carriage 20 and a linear slider assembly.

The carriage 20 forms a top of the rectilinear motion assembly. The carriage 20 includes a groove which receives substantially half of the moving part 16*b* of the linear shaft motor 16.

The linear slider assembly includes two sets of a first slider element 22*a*, 122*a* and a second slider element 22*b*, 122*b* which form sides of the rectilinear motion assembly. A first set is disposed on one side of the linear shaft motor 16 and a second set is disposed on the opposite side of the linear shaft motor 16.

Each first slider element 22*a*, 122*a* is in a form of a sliding block and each second slider element 22*b*, 122*b* is in a form of a shaped guide which is mounted to the base 12.

In the first embodiment, each first slider element 22*a* includes a recess extending along its length which is shaped and sized to receive its corresponding second slider element 22*b*. A top of each first slider element 22*a* is coupled to the end of the carriage 20 and is provided substantially on top of the second slider element 22*b*.

In the second embodiment, the first slider elements 122*a* are T-shaped elements. Each first slider element includes a first member and a second member extending perpendicularly from the centre of the first member to form the T-shape.

The second slider elements 122*b* are U-shaped elements. Each second slider element 122*b* includes two arms which are connected together at one of their ends to form the U-shape.

An outer surface of one of the arms of each U-shaped second slider element 122*b* abuts the base 12. The second member of the T-shaped first slider element is disposed between the arms of its corresponding second slider element. The first slider elements 122*a* do not abut or contact the base 12.

One first carrier magnet 24 is disposed within an aperture in each end of the first member of each T-shaped first slider element 122*a*. This can be seen more clearly in FIG. 7. One second carrier magnet 26 is disposed to each face of the second member of each T-shaped first slider element 122*a*. One base magnet 28 is disposed to an inner face of each arm of each U-shaped second slider element 122*b*. This allows the first carriage magnets 24 to be disposed to a lateral side of its corresponding base magnet 28 and help maintain the rectilinear movement of the rectilinear motion assembly. The second carriage magnets 26 and the base magnets 28 together allow the weight of the bed to be supported by motion imparting leg 100.

A gap is provided between the first 24 and second 26 carriage magnets, and the base magnets 28. The gap between the magnets of the first slider elements 122*a* and second slider elements 122*b* means that there is no contact or friction between the first slider elements 122*a* and second slider elements 122*b*. This helps to prevent wear of the rectilinear motion assembly, and no servicing or maintenance is required.

Figure 7:
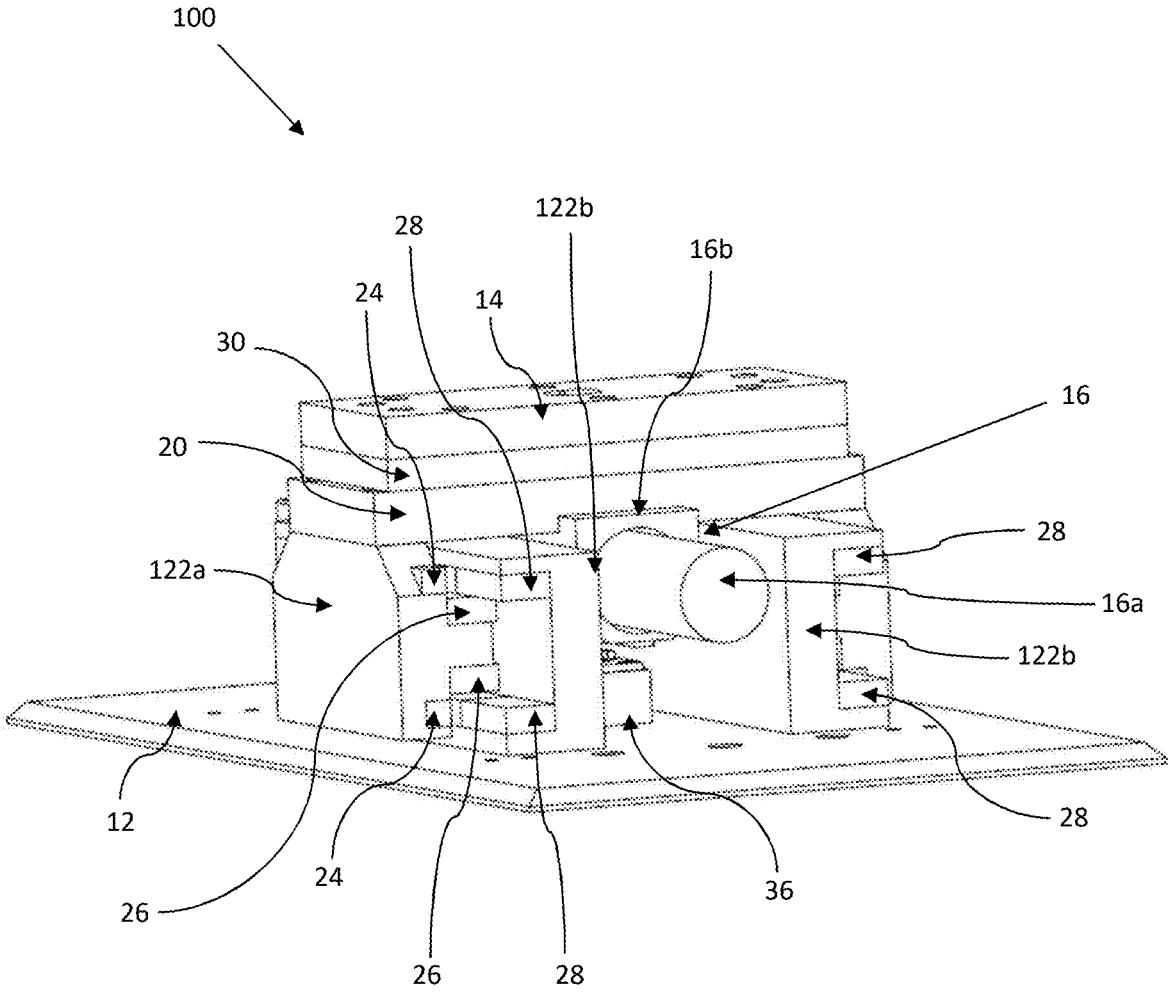
FIG. 7 shows a perspective view of the motion imparting leg of FIGS. 5 and 6 with a better view of its linear shaft motor.
Figure 8:
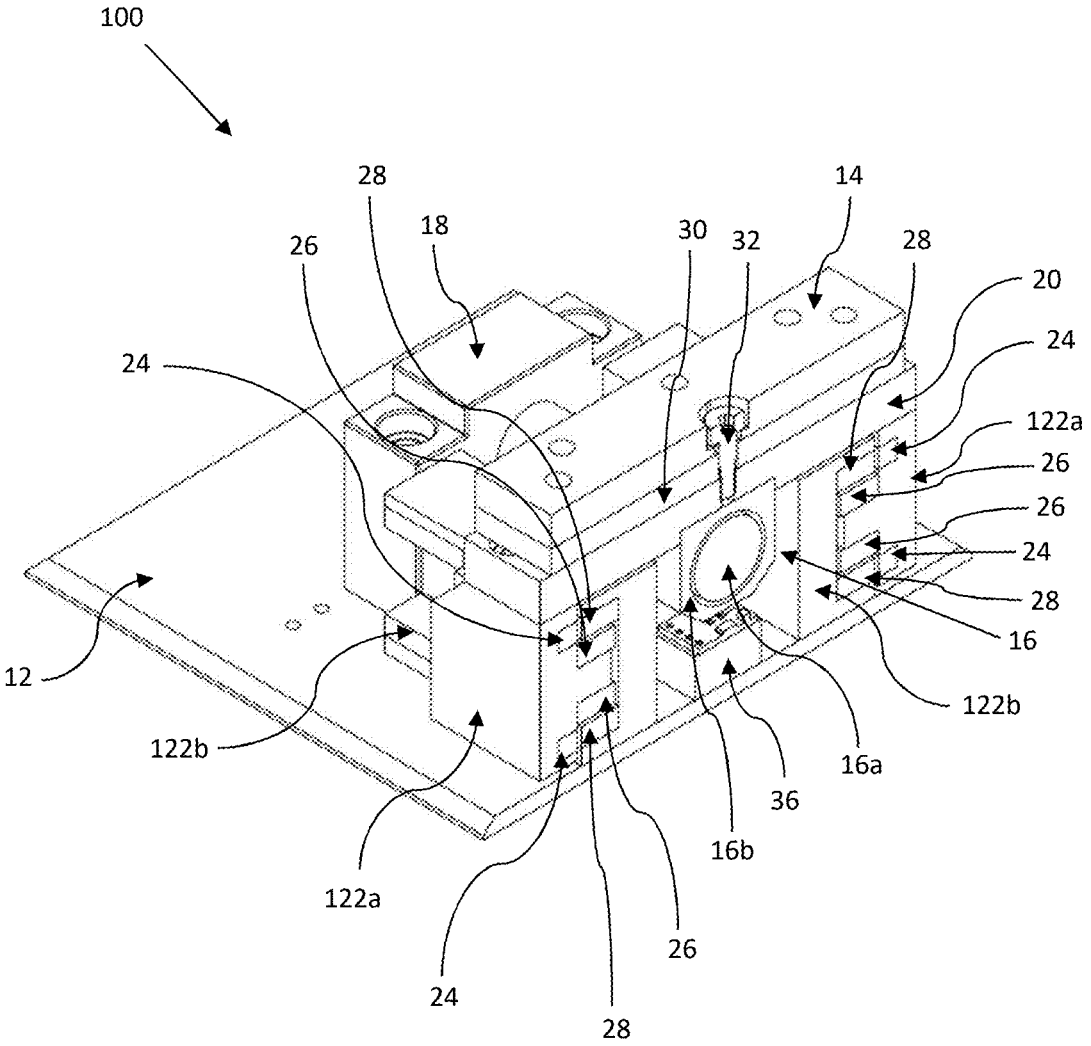
FIG. 8 shows a cross-sectional view of the motion imparting leg of FIGS. 5 to 7.

The magnets can be more clearly seen in FIG. 7. The magnets can be permanent magnets and/or electromagnets.

In both embodiments, the linear slider assembly supports the carriage 20 and ensures that, in use, the weight from the bed is transferred to the base 12 of the motion imparting leg. This allows the motion imparting leg 10, 100 to support heavier beds, as each leg can support more weight.

The linear slider assembly extends in a direction parallel to the fixed part 16*a* of the linear shaft motor 16. The rectilinear movement of the linear slider assembly is parallel to the rectilinear movement of the linear shaft motor 16.

The upper member 14 is coupled to the carriage 20. The upper member 14 is a rectangular and planar member which sits at the top of the carrier 20. The upper member 14 covers substantially the whole top surface of the carriage 20. The rectilinear motion assembly allows the upper member 14 to move in a rectilinear motion along the length of the fixed part 16*a* of the linear shaft motor 16.

Figure 9:
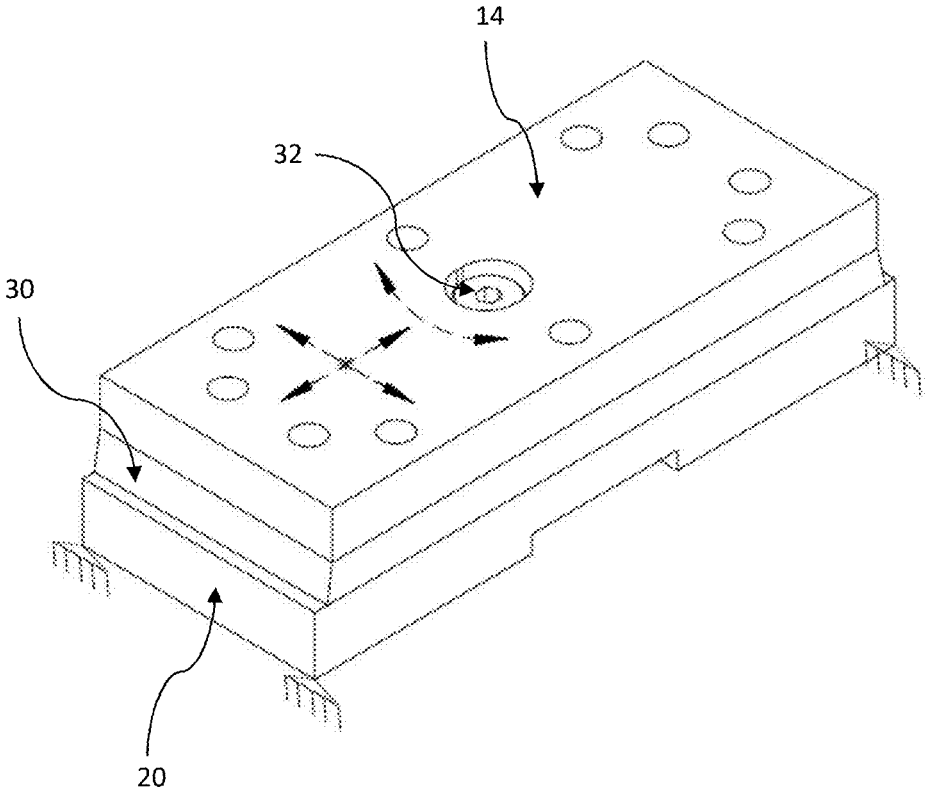
FIG. 9 shows a perspective view of an upper member and a top of a rectilinear motion assembly of the first and second embodiments.

A flexible or resilient member or layer 30 such as a rubber layer is provided between the upper member 14 and the carriage 20 of the rectilinear motion assembly. This can be more clearly seen in FIG. 9.

The flexible or resilient member 30 is coupled to the upper member 14 and the carriage 20 using adhesive. However, other coupling devices may be used, for example, galvanization. The flexible or resilient member 30 allows the upper member to rotate and translate in relation to the carriage 20.

This is useful for example, when the motion imparting leg 10, 100 is provided to the bed with other motion imparting legs. The rotation in B-B direction and translation in CC and D-D direction of the upper member 14 means that all the motion imparting legs attached to the bed do not have to be perfectly aligned with each other. This is because the upper member 14 can move slightly to align itself with the upper members of the other motion imparting legs.

A fastener 32 i.e., a screw extends through the upper member 14, the flexible or resilient member 30 and the carriage 20 for further securing them together.

Figure 10:
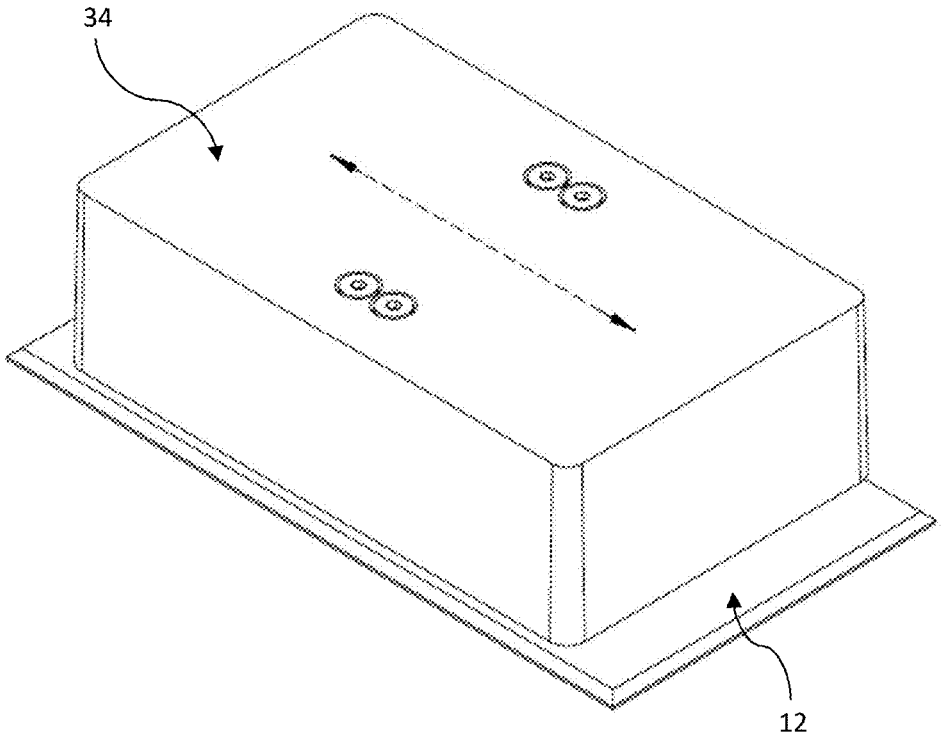
FIG. 10 shows a perspective view of the first and the second embodiments with a shroud attached.

A shroud 34 is provided for enclosing the components of the motion imparting leg 10, 100, as can be seen in FIG. 10. The shroud 34 is connected to the upper member 14 through fasteners such as a bolts or screws which extend through apertures in the upper member 14.

In this embodiment, a linear encoder 36 is mounted to the base 12 and disposed within the space between the base 12 and the linear shaft motor 16. However, in other embodiments, the linear encoder 36 may be disposed anywhere between fixed (e.g. base) and moving components (e.g. upper member, rectilinear motion assembly) of the motion imparting leg 10, 100, for example.

A motor controller (not shown) is connected to the linear encoder 36. The motor controller controls the speed of the linear shaft motor 16 based on positional data from the linear encoder 36. The motor controller also controls the speed of the motor 16 based on the desired motion or position path, for example, as received from a control hub.

When a plurality of motion imparting legs is retrofitted to a standard bed, the bed will oscillate or reciprocate back and forth in a horizontal plane, i.e. in a direction substantially parallel to the floor.

A central hub (not shown) for controlling and providing power to the motion imparting legs can be provided. The central hub can be connected to each motion imparting leg by cabling. The cabling provides a route for data communication and power.

The central hub receives data and/or signals from each motion imparting leg. The central hub may send commands, signals, data and/or information to each motion imparting leg. The central hub can be configured to synchronise the motion of the legs.

A safety system is provided and configured to determine unexpected operation of the motion imparting leg 10, 100. For example, the safety system may be used to determine if there is a decoupling, either complete or partial, between the rectilinear motion of components and the linear shaft motor 16. For example, decoupling may occur when the linear shaft motor displacement or movement is blocked by an obstacle, or when motor burns out, or when connection wires are disconnected.

If a decoupling has been determined, the motor controller generates a warning signal which is transmitted to the central hub. The central control hub may then generate a shutdown signal which is transmitted to all of the motion imparting legs 10, 100.

In some embodiments, the safety system uses data from the linear encoder 36 to determine if there is a decoupling. In other embodiments, the safety system uses data from the linear encoder 36 plus a monitored electrical value of the linear shaft motor 16, such as current.

The safety system is configured to determine excessive rectilinear motion. That is to say, the safety system determines that the upper member 14 has moved further than one end of its defined motion or travel path length. The safety system may use the rectilinear motion of other components, such as the rectilinear motion assembly or shroud 34, to infer the motion of the upper member 14.

The safety system includes two optical switches 38, 138 connected to the motor controller. Each optical switch 38, 138 is disposed towards an end of the linear slider assembly, specifically the second slider element 22*b*, 122*b*. Each optical switch 38, 138 has a switch gate comprised of two pillars with a light path disposed therebetween.

A blade 40, 140, or similar switch trigger, is disposed on either end of the first slider element 22*a*, 122*a*. Each blade 40, 140 extends out from the first slider element 22*a*, 122*a* towards an optical switch 38, 138. The blade 40, 140 actuates the optical switch 38, 138 by interrupting the light path in the switch gate.

During normal operation of the motion imparting leg 10, 100, the blades 40, 140 will not actuate the optical switches 38, 138.

If the optical switches 38, 138 are actuated, the motor controller generates a warning signal which is transmitted to the central hub. The central control hub may then generate a shutdown signal which is transmitted to all of the motion imparting legs 10, 100.

The optical switches 38, 138 may also be used in a method of calibrating a motion imparting leg 10, 100. The method will now be described with reference to the embodiments discussed above, however it is applicable to other types of motion imparting legs.

To calibrate the motion imparting leg 10, 100 and determine the maximum extent of possible rectilinear motion, the linear shaft motor 16 drives the rectilinear motion assembly until a blade 40, 140 actuates an optical switch 38, 138. The actuation of the optical switch 38, 138 is indicative of the end of the rectilinear motion path. The motor controller records positional data indicative of the end of the motion path.

Once one end has been recorded, the motion imparting leg 10, 100 undergoes the same steps but reverses the direction of the linear shaft motor 16 to determine the other end of the rectilinear path.

With both ends being recorded the extent of possible rectilinear motion, i.e. the maximum motion or travel path length, is determined and the rectilinear motion assembly is moved back towards a central position, i.e. about equal distance between both ends.

In the current embodiment, the optical switches 38, 138 are not to be triggered during normal operation of the motion imparting leg 10, 100. This means that the actual motion or travel path length has to be less than the maximum motion or travel path length so that the blades 40, 140 do not trigger the optical switches 38, 138.

In the current embodiment, the actual motion path length is 4 mm smaller than the maximum motion path length, that is to say there is a margin of 2 mm at either end.

The motion imparting leg may be supplied as a pre-calibrated unit. That is, the end user may not need to perform any calibration prior to installing/using the leg.

Although the first and second embodiments both include a linear shaft motor, other types of motor or motion path defining devices may be used to drive or cause or allow the rectilinear movement of the upper member.

The embodiments described above are provided by way of example only, and various changes and modifications will be apparent to persons skilled in the art without departing from the scope of the present disclosure as defined by the appended claims.

The invention claimed is:

1. A motion imparting leg for imparting an oscillating or reciprocating rectilinear motion to a bed for rocking the bed, the motion imparting leg comprising:

a base;

an upper member movable relative to the base for imparting the oscillating or reciprocating rectilinear motion;

a linear shaft motor for driving rectilinear movement of the upper member, the linear shaft motor comprising a fixed part and a moving part spaced apart from each other, the moving part being rectilinearly movable relative to the fixed part;

a position sensor for determining a position of the linear shaft motor or a position of the upper member;

a motor controller for controlling the linear shaft motor based on data from the position sensor;

a rectilinear motion assembly disposed between and coupled to the moving part of the linear shaft motor and the upper member, the rectilinear motion assembly comprising:

a carriage; and a linear slider assembly comprising a first slider element connected to each side of the carriage and a second slider element connected to the base, wherein the second slider element is disposed between the linear shaft motor and each first slider element.

2. The motion imparting leg as claimed in claim 1, wherein the upper member is disposed above or attached to the linear shaft motor.

3. The motion imparting leg as claimed in claim 1, wherein a rectilinear travel path of the upper member extends along a length of the fixed part of the linear shaft motor.

4. The motion imparting leg as claimed in claim 1, wherein the upper member is adapted to be displaced in a horizontal plane for allowing rotation and translation of the upper member relative to the base.

5. The motion imparting leg as claimed in claim 4, wherein:

the upper member includes flexible or resilient member for enabling displacement of the upper member; or the whole upper member is a flexible or resilient member.

6. The motion imparting leg as claimed in claim 5, wherein the flexible or resilient member is the part of the upper member coupled to the rectilinear motion assembly;

a fastener is provided for securing the rectilinear motion assembly and the upper member together; or the rectilinear motion assembly includes a groove for receiving at least part of the moving part of the linear shaft motor.

7. The motion imparting leg as claimed in claim 1, wherein each first slider element is substantially T-shaped and comprises a first member and a second member extending perpendicularly from a center of the first member.

8. The motion imparting leg as claimed in claim 7, wherein each second slider element is substantially U-shaped having two arms connected together, the second member of the first slider element being disposed between the arms of the second slider element.

9. The motion imparting leg as claimed in claim 1, wherein an arrangement of magnets or electromagnets is provided to the rectilinear motion assembly for supporting weight applied on the upper member and for maintaining the rectilinear movement of the rectilinear motion assembly.

10. The motion imparting leg as claimed in claim 9, wherein at least one first carriage magnet and at least one second carriage magnet are provided to each first slider element, and at least one base magnet is provided to each second slider element.

11. The motion imparting leg as claimed in claim 10, wherein the at least one first carrier magnet is disposed to a lateral side of the at least one base magnet, and the at least one second carriage magnet is disposed above or below the at least one base magnet.

12. The motion imparting leg as claimed in claim 10, wherein the at least one first carriage magnet and the at least one second carrier magnet are spaced apart from the at least one base magnet.

13. The motion imparting leg as claimed in claim 1, wherein the position sensor is mounted under the linear shaft motor.

14. The motion imparting leg as claimed in claim 1, wherein the upper member of each motion imparting leg is removably coupled to a bed frame or leg of a bed, wherein the motion imparting legs are attached around the periphery of the bed frame.

15. A kit of parts comprising a plurality of motion imparting legs as claimed in claim 1.

16. The kit of parts as claimed in claim 15, further comprising a central control hub for connection to each motion imparting leg, the central control hub synchronising the rectilinear motion of the motion imparting legs.

17. A motion imparting device for imparting an oscillating or reciprocating rectilinear motion to an object, the motion imparting device comprising:

a base;

an upper member movable on a motion path relative to the base for imparting the oscillating or reciprocating rectilinear motion to the object;

a drive or guide structure positioned at least partially between the base and the upper member;

a linear shaft motor for driving rectilinear movement of the upper member, the linear shaft motor comprising a fixed part and a moving part spaced apart from each other with a gap therebetween, the moving part being rectilinearly movable relative to the fixed part; and wherein the upper member is displaceable in a horizontal plane independently of its movement along the motion path, allowing for at least one of rotation or translation of at least part of the upper member relative to the base and the drive or guide structure.

18. The motion imparting device as claimed in claim 17, wherein the upper member is displaced in the horizontal plane.

19. The motion imparting device as claimed in claim 17, wherein the upper member further comprises rubber or another elastomeric material.

20. The motion imparting device as claimed in claim 17, wherein the upper member comprises a flexible member for enabling displacement or stretching or twisting of the upper member in the horizontal plane.

* * * * *